United States Patent [19]

Van Mens et al.

[11] Patent Number: 4,857,118

[45] Date of Patent: Aug. 15, 1989

[54] METHOD OF MANUFACTURING A PERMANENT MAGNET

[75] Inventors: Reinoud Van Mens, Eindhoven; Gijsbertus W. Turk, Mijdrecht, both of Netherlands

[73] Assignee: U.S. Philips Corporation, New York, N.Y.

[21] Appl. No.: 107,625

[22] Filed: Oct. 9, 1987

[30] Foreign Application Priority Data

Oct. 13, 1986 [NL] Netherlands ..... 8602566

[51] Int. Cl.[4] ..... H01F 1/09

[52] U.S. Cl. ..... 148/103; 148/105; 148/121

[58] Field of Search ..... 148/101, 103, 105, 121, 148/302

[56] References Cited

U.S. PATENT DOCUMENTS

| | | | |
|---|---|---|---|
| 3,655,464 | 4/1972 | Benz | 148/101 |
| 4,663,066 | 5/1987 | Fruchart et al. | 148/302 |
| 4,762,574 | 8/1988 | Ghandehari | 148/103 |

FOREIGN PATENT DOCUMENTS 77960 5/1985 Japan .

*Primary Examiner*—L. Dewayne Rutledge
*Assistant Examiner*—George Wyszomierski
*Attorney, Agent, or Firm*—Norman N. Spain

[57] ABSTRACT

Permanent magnets are manufactured by grinding a magnetic phase having the composition $RE_2(Fe, Co)_{14}B$ with a non-magnetic phase, orienting it magnetically, densifying and then sintering it. The non-magnetic phase may be a hydride of either a rare earth metal or alloy thereof. The second phase must have a melting point lower than the magnetic phase.

5 Claims, No Drawings

METHOD OF MANUFACTURING A PERMANENT MAGNET

BACKGROUND OF THE INVENTION

The present invention relates to a method of manufacturing a permanent magnet from a material which comprises fine crystallites of $RE_2(Fe,Co)_{14}B$, in which method the material is ground, oriented in a magnetic field, densified and subjected to a thermal treatment so as to form a mechanically stable body having optimum magnetic properties by means of liquid phase sintering. RE is to be understood to mean in this connection a rare earth metal or a mixture thereof, for example a Mischmetal. In a generally known composition RE=Nd which may optionally be replaced partly by Dy. Methods of this type are known per se, for example, from European patent application 0153744. It is explained on page 20 of the said patent application that magnetic materials based on iron, boron and a rare earth metal comprise at least 50% by volume of a magnetic phase having a tetragonal crystal structure. The chemical composition of this phase is $RE_2Fe_{14}B$ (wherein Fe may be partly replaced by Co). The magnetic material furthermore comprises a non-magnetic phase which surrounds the grains of the magnetic phase. Said non-magnetic phase consists primarily of rare earth metals. Such a material comprising at least two phases is obtained by preparing an alloy powder starting from a composition which is non-stoichiometric (for example $RE_{15}Fe_{77}B_8$) with respect to the composition $RE_2(Fe,Co)_{14}B$ and subjecting it to various temperature treatments.

This said method has at least one essential disadvantage. Alloy additions in the form of other rare earth metals with the object of controlling the magnetic and/or other properties change not only the composition of the magnetic phase but also that of the non-magnetic second phase.

SUMMARY OF THE INVENTION

It is the object of the present invention to provide a method which presents the possibility of controlling the composition of the magnetic phase and that of the non-magnetic second phase independently of each other to a great extent.

This object is achieved by means of a method of the type mentioned in the opening paragraph which is characeterized in that a metal alloy of the stoichiometric composition $RE_2(Fe,Co)_{14}B$ is ground together with another material which during the thermal treatment forms a second, liquid phase at the surface of the grains with composition $RE_2(Fe,Co)_{14}B$. Said second phase may consist of a solution of the stoichiometric composition in the other material. The other material consists preferably entirely or partly of one or more rare earth metals having a melting point lower than that of $RE_2(Fe,Co)_{14}B$. In principle these rare earth metals may be identical to the rare earth metal or metals which is (are) present in the starting alloy $RE_2(Fe,Co)_{14}B$.

In order to improve the grindability of the mixture it is desirable to use a material for the formation of the second phase which is comparable in brittleness to the starting alloy $RE_2(Fe,Co)_{14}B$ or has a greater brittleness. Brittleness is to be understood to mean therein the property of breaking readily showing no or little plastic deformation when subjected to a sufficiently large mechanical load.

Suitable material which satisfy this requirement are, for example, the hydrides of rare earth metals. Hydrides of alloys of other metals with rare earth metals may also be used, provided the $RE_2(Fe,Co)_{14}B$ phase does not disappear because of the presence of that other metal.

Examples of suitable alloys are alloys of aluminum with one or more rare earth metals. By using alloy metals such as aluminum the corrosion resistance of the permanent magnets according to the invention can be considerably improved.

The material for the formation of the second non-magnetic phase in the ultimate product must preferably be present to a sufficient extent to be able to surround each grain of the magnetic phase, on the other hand the second phase must not be present in such a large quantity that the magnetic properties are unnecessarily decreased thereby. In practice, good results are achieved with additions of from 7 to 12% by weight calculated on the weight of the magnetic phase with the composition $RE_2Fe_{14}B$. Favourable compositions can simply be determined by comparative tests.

DETAILED DESCRIPTION OF THE INVENTION

The method according to the invention will now be described in greater detail with reference to the ensuing specific examples:

EXAMPLE 1

An alloy of the stoichiometric composition $Nd_2Fe_{14}B$ was prepared in the conventional manner by mixing the starting materials and melting. The alloy was annealed at 1050° C. for 100 hours. The resulting product was substantially mono-phase. The alloy was ground to a grain size between 2 and 50 μm and was mixed with 10% by weight calculated on the weight of the alloy of a hydride of dysprosium which comprised approximately 1% by weight of hydrogen ($DyH_{1.7}$). The mixture was ground in a ball mill for 60 minutes. The resulting material was then oriented in a magnetic field of 8 T, compressed isostatically to form a cylindrical body and sintered (1 hour at 1080° C.), followed by 2 hours at 860° C. and then 2 hours at 630° C.).

The resulting bodies have the gross composition $(Nd_2Dy_{0.67})Fe_{14}B$.

The resulting bodies had the following magnetic properties: $H_c=1950$ kAm$^{-1}$, $B_r=1.05$ T.

EXAMPLES 2-14

The compositions 2-14 in Table 1 were prepared in quite the same manner as in example 1. The additions indicated in the table were used. Magnets were obtained herewith having the magnetic properties indicated in the table.

TABLE I

| Additions alloyed upon grinding with stoichiometric $Nd_2Fe_{14}B_1$ composition. | | | | | | | |
|---|---|---|---|---|---|---|---|
| | Addition during | Magnetic Properties | | | | grinding | sintering |
| Prep. no. | grinding 10% by wt. | Br T | Bs T | Hc kA/m | ρ gr/cm$^3$ | time hrs | temp. °C. (*) |
| 2 | LaH | 1.02 | 1.15 | 180 | 7.11 | 1.0 | 1080 630 |
| 3 | CeH | 1.01 | 1.12 | 440 | 7.16 | 1.0 | 1080 630 |
| 4 | PrH | 1.05 | 1.17 | 344 | 7.08 | 1.5 | 1080 630 |
| 5 | NdH | 1.04 | 1.18 | 616 | 7.31 | 1.5 | 1080 |
| 6 | TbH | 1.05 | 1.11 | 2400 | 7.56 | 1.0 | 1060 |
| 7 | DyH | 1.05 | 1.10 | 1800 | 7.47 | 2.5 | 1080 |
| 8 | $Nd_{85}Al_{15}H$ | 1.11 | 1.24 | 608 | 7.42 | 1.0 | 1000 |
| 9 | $Nd_{75}Ni_{25}H$ | 1.08 | 1.23 | 416 | 7.39 | 1.0 | 1020 630 |

TABLE I-continued

| Prep. no. | Addition during grinding 10% by wt. | Magnetic Properties Br T | Bs T | Hc kA/m | ρ gr/cm³ | grinding time hrs | sintering temp. °C. (*) |
|---|---|---|---|---|---|---|---|
| | Additions alloyed upon grinding with stoichiometric $Nd_2Fe_{14}B_1$ composition. | | | | | | |
| 10 | $Nd_2DyAlH$ | 1.07 | 1.17 | 590 | 7.31 | 1.0 | 1000 |
| 11 | $Dy_{80}Al_{20}H$ | 0.95 | 1.01 | 1216 | 7.51 | 1.0 | 1000 630 |
| 12 | $Dy_{70}Ni_{30}H$ | 0.87 | 0.95 | 1152 | 7.24 | 1.01 | 1080 630 |
| 13 | $Pr_{75}Ni_{25}H$ | 1.14 | 1.25 | 500 | 7.14 | 2.0 | 1060 630 |
| 14 | $Tb_{75}Al_{25}H$ | 1.00 | 1.04 | 1630 | 7.22 | 2.0 | 1060 630 |

(*) in case no second temperature is mentioned, the material was sintered during 1 hr at the first temperature only and thereafter in an oven slowly cooled down to ambient at a rate of 150° C. per hour, in case a second temperature is mentioned the material after sintering for one hour at the second kept for one hour at the second temperature and thereafter quenched in air to the ambient temperature.

EXAMPLES 5–21

Compositions 15–21 were prepared as in the preceding example, see Table 2.

TABLE 2

| Prep. no. | Alloy Composition | 10 wt. % addition | Magnetic Properties Br T | Bs T | Hc kA/m | ρ gr/cm³ | grinding time hrs | sintering temp. °C. |
|---|---|---|---|---|---|---|---|---|
| 15 | $Nd_1La_1Fe_{14}B_1$ | $Nd_{85}Al_{15}H$ | 0.69 | 0.95 | 336 | 6.35 | 1.0 | 1060 |
| 16 | $Nd_1Ce_1Fe_{14}B_1$ | $Nd_{85}Al_{15}H$ | 1.00 | 1.13 | 540 | 7.47 | 1.0 | 970 |
| 17 | $MM^x)_2Fe_{14}B_1$ | DyH | 0.75 | 0.85 | 400 | 7.07 | 1.0 | 1070 |
| 18 | $MM_2Fe_{14}B_1$ | NdH | 0.79 | 1.02 | 120 | 6.61 | 1.0 | 950 |
| 19 | $Nd_{1.95}Dy_{0.05}Fe_{14}B_1$ | NdH | 1.13 | 1.26 | 624 | 7.39 | 1.0 | 1070 + 630 (1) |
| 20 | $Nd_{1.90}Dy_{0.10}Fe_{14}B_1$ | NdH | 1.23 | 1.33 | 640 | 7.42 | 1.0 | 1070 + 630 (1) |
| 21 | $Nd_{1.50}Dy_{0.50}Fe_{14}B_1$ | NdH | 1.15 | 1.21 | 1140 | 7.71 | 1.0 | 1060 |

(x) = Mischmetal
(1) see note under Table I.

The resistance against corrosion in the magnets obtained by the method according to the invention is considerably improved.

When the magnets are subjected to the following test: 8 hours at 25° C. in an atmosphere having a relative humidity of 100% and then 16 hours at 55° C. in the same atmosphere, a beginning of corrosion proves to occur only after 9 days. The magnet still has substantially the original shape. In the commercially available magnets having a fine crystalline hard magnetic phase $RE_2(Fe,Co)_{14}B$, for example $Nd_2Fe_{14}B$ embedded in a neodymium iron phase it has been found that the magnet has decomposed entirely already after 3 days. The method furthermore has the advantage that during the manufacture of the magnets an optimum starting composition for the hard magnetic phase can be chosen without it being necessary to take the composition of the embedding phase into account. This increases the flexibility in series production of this type of magnets. It has been found that the grinding properties are also considerably improved when using the method according to the invention. When a hydride is used the hydrogen disappears from the material during the thermal treatment (sintering).

Naturally, another substance having a positive effect on the magnetic properties of the sintered material may be added together with the material on the basis of a rare earth metal.

What is claimed is:

1. A method of manufacturing a permanent magnet from a material comprising a finely crystalline rare earth metal transition element boride of the formula $RE_2(Fe,Co)_{14}B$ wherein RE is at least one rare earth metal, comprising grinding said crystalline material, orienting the resultant ground material in a magnetic field, compressing the resulting magnetically oriented ground material into a densified body and then sintering said densified body in such a manner as to form a first liquid phase while sintering to form thereby a mechanically stable densified body, wherein during the grinding step a material of a different composition is added to stoichiometric $RE_2(Fe,Co)_{14}B$ which material is a hydride of a rare earth metal or of an alloy of a rare earth metal and which, during the sintering step, forms a second liquid phase on the surface of the grains of the $RE_2(Fe,Co)_{14}B$.

2. A method as claimed in claim 1, wherein the material of a different composition consists of a hydride of one or more rare earth metals.

3. A method as claimed in claim 1, wherein the material of a different composition consists of a hydride of an alloy of one or more rare earth metals and another metal.

4. A method as claimed in claim 3, wherein the material of a different composition consists of a hydride of an alloy of aluminum and one or more rare earth elements.

5. The method of claim 1 wherein the material of different composition consists at least of a hydride of part any rare earth metal selected from the group consisting of yttrium and lanthanum.

* * * * *